United States Patent [19]

Heydner

[11] 4,111,474

[45] Sep. 5, 1978

[54] ELECTRICALLY OPERATED DOOR LOCK

[75] Inventor: Konrad Heydner, Altdorf, Germany

[73] Assignee: Ellenberger & Poensgen GmbH, Altdorf, Germany

[21] Appl. No.: 807,323

[22] Filed: Jun. 16, 1977

[30] Foreign Application Priority Data

Jun. 25, 1976 [DE] Fed. Rep. of Germany ..... 2628597

[51] Int. Cl.[2] ..... E05B 51/00

[52] U.S. Cl. ..... 292/144; 292/DIG. 66; 292/DIG. 69; 337/107

[58] Field of Search ..... 292/144, 201, DIG. 66, 292/DIG. 69; 70/DIG. 10, 275, 277, 280, 281; 337/107

[56] References Cited

U.S. PATENT DOCUMENTS

| | | | |
|---|---|---|---|
| 1,876,894 | 9/1932 | Fitzgerald | 292/DIG. 66 |
| 2,520,906 | 9/1950 | Cade | 337/107 |
| 2,598,067 | 5/1952 | O'Brien | 292/DIG. 66 |
| 2,910,317 | 10/1959 | Conlee | 292/144 X |
| 3,275,832 | 9/1966 | Curtin | 337/107 X |
| 3,643,479 | 2/1972 | Solow | 292/144 X |
| 3,870,983 | 3/1975 | Kato et al. | 337/107 |
| 4,032,180 | 6/1977 | Pohl | 292/DIG. 69 |
| 4,037,316 | 7/1977 | Stoll | 337/107 X |

FOREIGN PATENT DOCUMENTS

| | | | |
|---|---|---|---|
| 1,509,244 | 12/1967 | France. | |
| 1,953,983 | 5/1971 | Fed. Rep. of Germany | 292/DIG. 69 |
| 1,678,088 | 8/1971 | Fed. Rep. of Germany | 292/144 |
| 2,124,895 | 11/1972 | Fed. Rep. of Germany | 292/DIG. 66 |
| 540,197 | 10/1941 | United Kingdom | 337/107 |

*Primary Examiner*—Rodney H. Bonck
*Attorney, Agent, or Firm*—Spencer & Kaye

[57] ABSTRACT

An electrically operated door lock has a bolt movable into locking and unlocking positions; a generally cylindrical, positive temperature coefficient resistor; and a bimetal strip formed of a generally circular, open collar continuing in two spaced legs extending away from the resistor. The collar surrounds the resistor along its generally cylindrical surface. One of the two spaced legs constitutes a bolt-actuating terminus connected, directly or indirectly, with the bolt for moving the bolt upon deformation of the bimetal strip resulting from temperature changes caused by the resistor.

11 Claims, 5 Drawing Figures

ELECTRICALLY OPERATED DOOR LOCK

BACKGROUND OF THE INVENTION

This invention relates to a door lock, particularly for electrical appliances such as washing machines, dryers, etc. The door lock is of the type that has a bimetal strip, an electric resistance for heating the strip, as well as a bolt shiftable into its locking position by an outwardly deforming terminus of the heated bimetal strip and shiftable into its unlocking position by the bimetal strip as the latter cools and assumes its original position.

SUMMARY OF THE INVENTION

It is an object of the invention to provide an improved door lock of the above-outlined type which, on the one hand, is of simple and compact structure and, on the other hand, ensures a rapid locking action, while the bolt has a sufficiently large locking path.

A rapid locking action is particularly of significance if, for safety reasons, it has to be ensured that certain work cycles of the electric appliance (with which the door lock is associated), for example, the spinning cycle of a washing machine, is blocked until the appliance door is safely locked (bolted), while, at the same time, the delay between cycles, that is, the period between cycle selection and its start is limited. Thus, in case of washing machine doors, the bolting operation has to be effected within an approximately 20 second delay between cycles.

The above-noted objects and others to become apparent as the specification progresses, are accomplished by the invention, according to which, briefly stated, the electrically operated door lock has a bolt movable into locking and unlocking positions; a generally cylindrical, PTC resistor; and a bimetal strip formed of a generally circular, open collar continuing in two spaced legs extending away from the resistor. The collar surrounds the resistor along its generally cylindrical surface. One of the two spaced legs constitutes a bolt-actuating terminus connected, directly or indirectly, with the bolt for moving the bolt upon deformation of the bimetal strip resulting from temperature changes caused by the resistor.

It is noted that PTC resistors (where PTC stands for Positive Temperature Coefficient) are characterized by an electric resistance which increases with increasing temperature. PTC resistors for heating bimetal strips in electric control apparatus are conventionally used in order to ensure a short heating period and an automatic output limitation without the use of a series (compensating) resistance. In this connection reference is made to French Pat. No. 1,509,244. In the door lock (bolting device) according to the invention the heating of the bimetal strip is effected by applying thereto a voltage, particularly the line voltage.

The invention makes possible a reduction of the radiation losses of the PTC resistor to a minimum. This ensures, together with the known, very rapid temperature increase (up to the triggering temperature) in PTC resistors, a very short bolting period (less than 7 seconds).

In accordance with a further feature of the invention, the bimetal strip surrounds the resistor with a small clearance. This feature favors a rapid heat transfer from the surface of the resistor to the bimetal strip. Optimally, the bimetal strip, in its cold condition lies — without stress, however — on the generally cylindrical surface of the resistor.

In a preferred embodiment of the invention, the bolt is arranged on that lateral side of the cylindrical resistor which is about diametrically opposite the bolt-actuating terminus of the bimetal strip and further, between the bolt-actuating terminus and the bolt a connecting bar is provided which extends externally of the bimetal strip along its side oriented away from the resistor. These features make possible a compact accommodation of intermediate components which increase the path of displacement of the bolt-actuating terminus of the bimetal strip. It is noted in this connection that the smaller the diameter of the resistor, the smaller the path of displacement which the bolt-actuating terminus of the bimetal strip (positioned about the resistor) executes during heating. In order to ensure, nevertheless, for the bolt, a locking path of the greatest possible magnitude, the bolt-actuating terminus of the bimetal strip can be radially outwardly prolonged with respect to the longitudinal axis of the resistor in a direction oriented away from the resistor. The above-noted features, however, ensure that this prolongation extends in a space which is, in any event, needed for accommodating the resistor.

According to a further feature of the invention, the above-noted connecting bar is, at the same time, a compensating bimetal strip. This feature provides the possibility of enlarging the locking path of the bolt, since the connecting bar, in response to the heating effect, also deforms outwardly and thus compensates for the rotational motion of the bimetal strip and consequently, the bolt-actuating terminus of the connecting bar performs more of a translational than a rotational motion in the direction of the bolt movements.

In accordance with further inventive features which constitute alternatives or further developments of those discussed in the previous paragraph, the connecting bar coupling the bolt-actuating terminus of the bimetal strip with the bolt is constituted by the longer arm of a two-arm lever which has a pivotal axis disposed in the zone of the bolt-actuating terminus of the bimetal strip. Further, the door lock housing is provided with an abutment for limiting the pivotal motion of the shorter arm of the lever; the shorter arm of the lever will then engage the abutment as the bolt-actuating terminus of the bimetal strip bends outwardly. These features provide that a transmission of the displacing motion of the bolt-actuating terminus of the bimetal strip occurs by lever action which has the purpose to increase the extent of the stroke (locking path) of the bolt and to compensate for the rotary motion of the bolt-actuating terminus by pivotal motion in the opposite direction.

In another preferred embodiment of the invention, the bolt-actuating terminus of the bimetal strip is oriented towards the bolt and directly engages the latter, thus dispensing with a component corresponding to the connecting bar of the earlier-outlined preferred embodiment.

In accordance with a further feature of the invention — which may be incorporated in either preferred embodiment — at the free end of the connecting bar (in the case of the first preferred embodiment) or at the bolt-actuating terminus of the bimetal strip (in the case of the second preferred embodiment), on the one hand, and at the shorter arm of the two-arm lever (in the case of the first preferred embodiment) or at the support terminus of the bimetal strip (in the case of the second preferred embodiment), on the other hand, there is provided an electric contact member movable as a unit with these components and further, these movable contact components cooperate with fixed contacts supported in the housing in order to close an electric circuit as the locking stroke of the bolt takes place. These features provide in a simple manner that the heating of the bimetal strip for actuating the bolt of the door lock is simultaneously used for closing an electric circuit, for example, for starting a spin motor in a washing machine.

DESCRIPTION OF THE PREFERRED EMBODIMENTS

Figure 1:
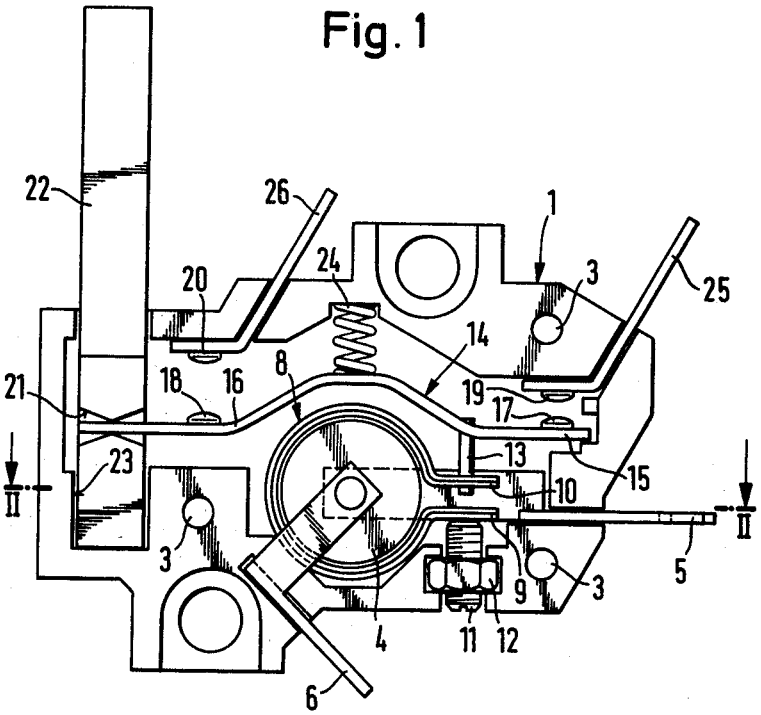
FIG. 1 is an elevational view of a preferred embodiment of the invention, with part of the housing removed, showing the structure in the unlocking state.
Figure 2:
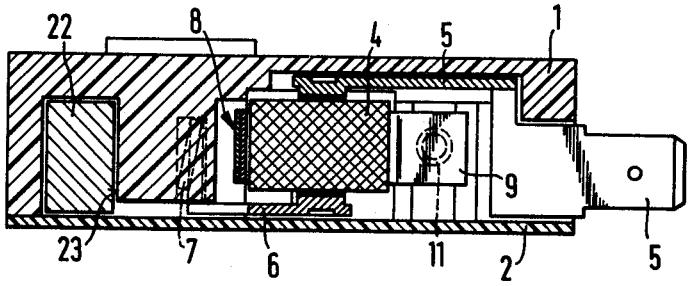
FIG. 2 is a sectional view taken along line II—II of FIG. 1.
Figure 3:
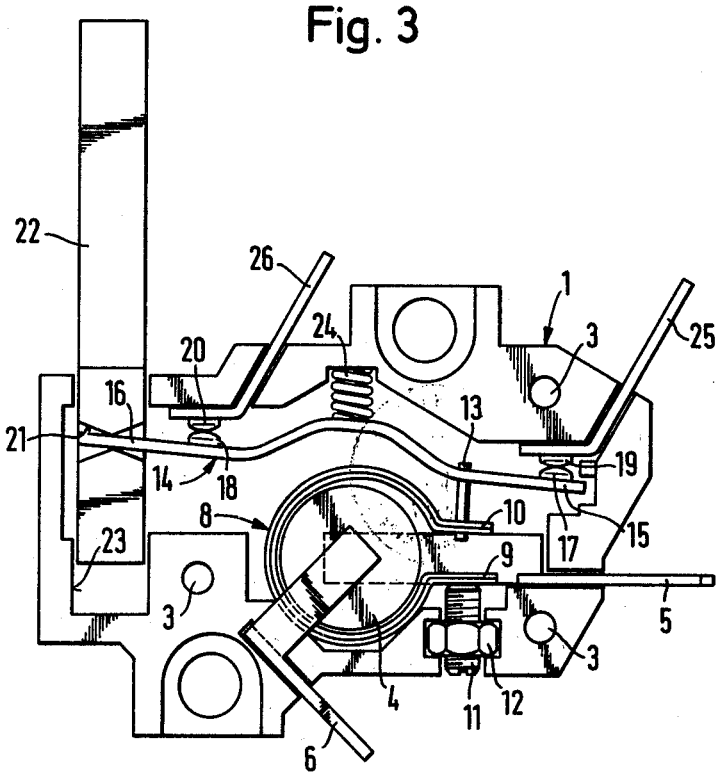
FIG. 3 is an elevational view of the same embodiment, showing the structure in the locking state.

Turning now to FIGS. 1, 2 and 3, the embodiment shown therein has a housing formed of a body portion 1 and a plate-like closure portion 2 (shown only in FIG. 2). The two housing portions may be secured to one another, for example, by screws or rivets passing through apertures 3 provided in the housing body 1. In a recess provided in the housing body 1 there is inserted a generally cylindrical PTC resistor 4. Electric terminal strips 5 and 6 engage each radially extending end face of the resistor and project outwardly from the housing, to be connected, for example, to a line voltage via a circuit breaker switch controlled in a conventional manner that does not form an integral part of the invention. The terminal strip 6 is immobilized in its position by a barb 7 received in an opening of the housing body 1 in order to ensure a permanent contacting of the terminals 5 and 6 with the opposite end faces of the resistor 4.

About the cylindrical surface of the resistor 4 there is bent a bimetal strip 8 which is generally Ω-shaped; it thus has a part constituting an open annulus or collar, continuing in two spaced, adjacent legs bent to extend approximately radially away from the collar. The collar part of the bimetal strip 8 surrounds the resistor 4 with a clearance of approximately 0.2 to 0.3 mm. One of the outwardly extending legs of the bimetal strip 8 constitutes a bolt-actuating terminus 10, while the other leg constitutes a support terminus 9 which engages a set screw 11. The latter is threaded through a nut 12 which is immobilized in the housing body 1 in a complemental recess thereof. The housing closure 2, when in place, holds the nut 12 in its angular position in the housing body 1 as shown in FIG. 1.

The housing body 1 slidably supports, in a recess 23, a bolt 22 which is arranged at that side of the cylindrical resistor 4 which is oriented diametrically opposite the bolt-actuating terminus 10. The bolt 20 may assume a withdrawn (unlocking) position (FIG. 1) or an advanced (locking) position (FIG. 3) for locking (bolting) a door of, for example, a washing machine.

In the housing body 1 there is further positioned a two-arm lever 14 pivotally attached to a pin 13 which, in turn, is secured to the bolt-actuating terminus 10 of the bimetal strip 8. The pin 13 divides the lever 14 into a short arm 15 and a long arm 16. The long arm 16 constitutes a connecting bar which, with its free end remote from the pin 13 extends into an opening 21 of the bolt 22 for providing a bi-directional force-transmitting coupling therewith. The connecting bar extends over the resistor 4.

To each arm 15 and 16 of the lever 14 there is secured an electric contact 17 and 18, respectively, which cooperate with respective fixed contacts 19 and 20 fastened to the housing body 1 and to respective terminal strips 25 and 26 which project outwardly of the housing body 1 and which may be connected to the circuit of, for example, the spin motor of an associated washing machine. The lever 14 can thus constitute a contact bridge to close an electric circuit simultaneously with the actuation of the bolt 22, as will be described later.

Advantageously, the lever (or its arm 16) may also be a bimetal member for further increasing — by virtue of its heat-caused deformation — the actuating path along which the bolt 22 is displaced. The bimetal member 14 also compensates for possible disturbing effects of the external, ambient temperature.

A compression spring 24 supported in the housing body 1 and engaging the arm 16 of the lever 14 urges the latter in the direction of the resistor 4 and thus urges the bolt 22 into its withdrawn, unlocking position and seeks to maintain it there.

In the description which follows, the operation of the above-discussed door lock will be set forth.

If, for example, a program control applies an electric current to the resistor 4 by applying a line voltage to the terminals 5 and 6 contacting the resistor 4, a relatively rapid heating of the PTC resistance occurs. The heat generated is transferred to the bimetal strip 8 which, as a result, deforms radially outwardly, that is, the distance between the termini 9 and 10 increases. Since the set screw 11 prevents the support terminus 9 from moving, the increase of the distance between the termini 9 and 10 will be brought about only by the displacement of the bolt-actuating terminus 10. The motion of the terminus 10 is transmitted by the pin 13 to the lever 14, and as a result, the lever 14 moves away from the resistor 4 against the force of the spring 24, whereby first the movable contact 17 engages the associated fixed contact 19 and then, after further (pivotal) motion of the lever 14, the movable contact 18 engages the associated fixed contact 20. Simultaneously, the outer free end of the arm 16 of the lever 14 moves the bolt 22 from its unlocking (withdrawn) position into its locking (advanced) position in which the door associated with the locking device is thus bolted. By virtue of the engagement of the movable contacts 17, 18 with the associated fixed contacts 19 and 20, the circuit of, for example, the spin motor of the associated washing machine is closed and thus the spinning cycle may start.

FIG. 1 illustrates the locking device in the inoperative state (the bolt 22 is in its unlocking position and the contacts 18, 20 and 17, 19 are open), whereas FIG. 3 shows the device in its operative state (the bimetal strip is outwardly deformed, the bolt 22 is in its locking position and the contacts 18, 20 and 17, 19 are closed).

Upon opening of the circuit of the resistor 4, the bimetal strip 8 is allowed to contract so that, under the supporting effect of the compression spring 24, the lever 14 returns into its position shown in FIG. 1 and consequently it draws the bolt 22 back into its unlocking position so that the associated door becomes unlocked and thus may be opened from the outside.

Figure 5:
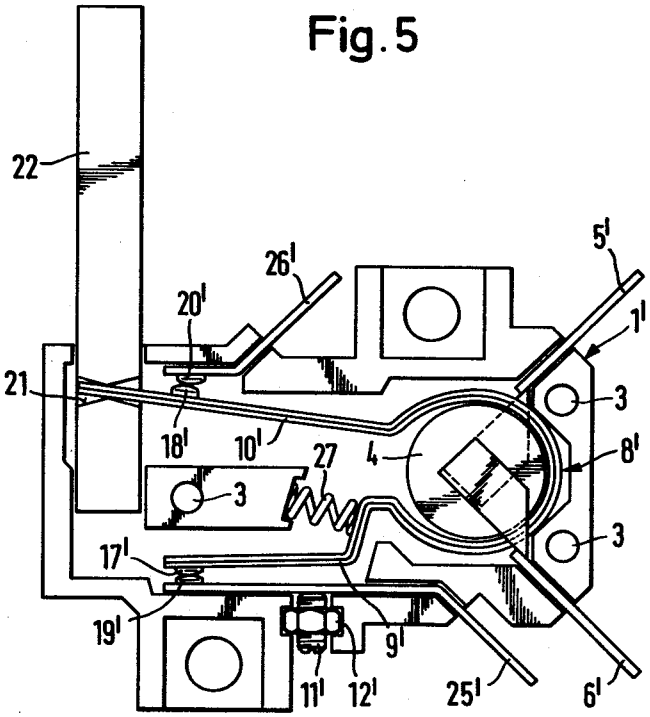
FIGS. 4 and 5 are elevational views of another preferred embodiment of the invention, with the housing partially removed, showing the structure in the unlocking and locking states, respectively.
Figure 4:
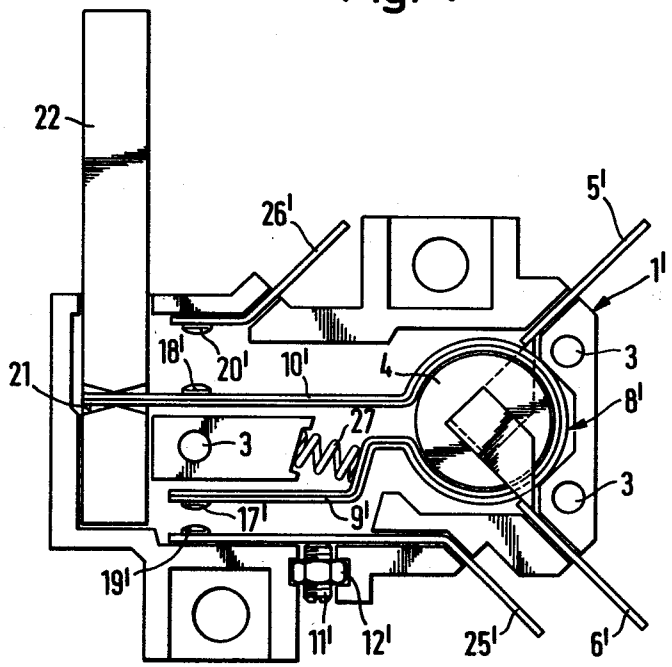

Turning now to FIGS. 4 and 5, the embodiment illustrated therein is characterized by the omission of the component corresponding to the two-arm lever 14 in the first embodiment. Here too, the device comprises a housing formed of a housing body 1' and a closure, not shown, which may be secured to the housing body by means of screws or rivets extending into openings 3 provided in the housing body 1'. Terminal strips 5' and 6' serve for electrically connecting the resistor 4 to the line voltage. The generally Ω-shaped bimetal strip 8' has relatively long, approximately radially outwardly extending spaced legs, one of which constitutes the support terminus 9' and the other constitutes the bolt-actuating terminus 10'. A set screw 11' is threaded into a nut 12' which is immobilized in a complemental recess in the housing body 1'. To the support terminus 9' of the bimetal strip 8' there is fastened a movable contact 17' which cooperates with a fixed contact 19' which, in turn, is secured to a terminal strip 25'. The bolt-actuating terminus 10' of the bimetal strip 8' is provided with a movable contact 18' which cooperates with a fixed contact 20' which, in turn, is secured to a terminal strip 26'. The bolt-actuating terminus 10' of the bimetal strip 8' projects into the recess 21 of the bolt 22 and thus directly engages the latter. A spring 27 is supported in the housing body 1' and engages the support terminus 9' of the bimetal strip 8' in such a manner that the terminus 9' is held (suspended) in a stable manner in its position of rest.

As soon as the bimetal strip 8' is heated by the PTC resistor 4, the termini 9' and 10' move away from one another until they assume their position illustrated in FIG. 5. In this position the movable contact 17' engages the associated stationary contact 19' and the movable contact 18' engages the associated stationary contact 20'. In this embodiment it is thus the bimetal strip 8' itself which, in addition to directly moving the bolt 22, acts as a contact bridge to establish an electric contact between the stationary contacts 19' and 20'. As the bolt-actuating terminus 10' of the bimetal strip 8' executes its above-noted motion, the bolt 22 is moved thereby from its unlocking position shown in FIG. 4 into its locking position shown in FIG. 5.

As the bimetal strip 8' contracts subsequent to the heating step, the locking device, by virtue of the reverse deformation of the bimetal strip 8', assumes its position illustrated in FIG. 4.

It will be understood that the above description of the present invention is susceptible to various modifications, changes and adaptations, and the same are intended to be comprehended within the meaning and range of equivalents of the appended claims.

What is claimed is:

1. In an electrically operated door lock including a bolt having locking and unlocking positions; a bimetal strip coupled to the bolt for moving the bolt into the one or the other bolt position dependent upon the direction of temperature-effected deformation of the bimetal strip; and a resistor for heating the bimetal strip for effecting deformation thereof; the improvement wherein said resistor is a PTC resistor having a generally cylindrical body, and wherein said bimetal strip is formed of a generally circular open collar and two spaced legs; said collar circumferentially surrounding said resistor and continuing in said legs; said legs extending in a direction away from said resistor; one of said legs constituting a bolt-actuating terminus; said bolt being arranged on that side of said resistor that is oriented away from said bolt-actuating terminus; the improvement further comprising a bimetal connecting bar coupling said bolt-actuating terminus with said bolt, said bimetal connecting bar extending adjacent and along a face of said collar oriented away from said resistor.

2. An electrically operated door lock as defined in claim 1, further comprising a housing accommodating said bolt, said resistor, said bimetal strip and said connecting bar; and a spring supported in said housing and engaging said connecting bar for urging said bolt into said unlocking position through said connecting bar.

3. An electrically operated door lock as defined in claim 1, wherein the other of said legs of said bimetal strip constitutes a support terminus for said bimetal strip; the improvement further comprising a housing accommodating said bolt, said resistor, said bimetal strip and said connecting bar; and an adjustable abutment supported in said housing and being in continuous contact with said support terminus for preventing displacement thereof during deformation of said collar.

4. In an electrically operated door lock including a bolt having locking and unlocking positions; a bimetal strip coupled to the bolt for moving the bolt into the one or the other bolt position dependent upon the direction of temperature-effected deformation of the bimetal strip; and a resistor for heating the bimetal strip for effecting deformation thereof; the improvement wherein said resistor is a PTC resistor having a generally cylindrical body, and wherein said bimetal strip is formed of a generally circular open collar and two spaced legs; said collar circumferentially surrounding said resistor and continuing in said legs; said legs extending in a direction away from said resistor; one of said legs constituting a bolt-actuating terminus; said bolt being arranged on that side of said resistor that is oriented away from said bolt-actuating terminus; the improvement further comprising (a) a lever and a pivot means pivotally supporting said lever and dividing said lever into a long arm and a short arm; said long arm constituting a connecting bar coupling said bolt-actuating terminus with said bolt and extending adjacent and along a face of said collar oriented away from said resistor; said pivot means being attached to said bolt-actuating terminus;

(b) a housing accommodating said bolt, said resistor, said bimetal strip, said lever and said pivot means; and (c) a stationary abutment supported in said housing and cooperating with said short arm to abut said short arm during motion of said lever and said bolt-actuating terminus in response to an outward deformation of said collar.

5. An electrically operated door lock as defined in claim 4, wherein said collar surrounds said resistor with a small clearance.

6. An electrically operated door lock as defined in claim 4, wherein said lever is a bimetal lever.

7. An electrically operated door lock as defined in claim 4, further comprising spaced stationary electric contacts secured to said housing; said lever constituting a movable contact bridge cooperating with said stationary electric contacts; said lever electrically connecting said stationary electric contacts upon outward deformation of said collar and said lever electrically disconnecting said stationary contacts from one another upon inward deformation of said collar.

8. An electrically operated door lock as defined in claim 7, wherein one of said stationary electric contacts cooperates with said short arm and another of said stationary contacts cooperates with said long arm.

9. In an electrically operated door lock including a bolt having locking and unlocking positions; a bimetal strip coupled to the bolt for moving the bolt into the one or the other bolt position dependent upon the direction of temperature-effected deformation of the bimetal strip; and a resistor for heating the bimetal strip for effecting deformation thereof; the improvement wherein said resistor is a PTC resistor having a generally cylindrical body, and wherein said bimetal strip is formed of a generally circular open collar and two spaced legs; said collar circumferentially surrounding said resistor and continuing in said legs; said legs extending in a direction away from said resistor; one of said legs constituting a bolt-actuating terminus directly connected with said bolt; said bolt being arranged on that side of said collar from which said bolt-actuating terminus extends; the other of said legs of said bimetal strip constituting a support terminus for said bimetal strip; said support terminus being spaced from said abutment in the normal, contracted state of said collar and being in contact with said abutment in the expanded, outwardly deformed state of said collar; the improvement further comprising (a) a housing accommodating said bolt, said resistor and said bimetal strip;

(b) an adjustable abutment supported in said housing for contacting said support terminus for limiting the displacement thereof during outward deformation of said collar; and (c) a spring supported in said housing and engaging said support terminus for urging said support terminus into the position spaced from said abutment and for urging said bolt into said unlocking position through said collar and said bolt-actuating terminus.

10. An electrically operated door lock as defined in claim 9, further comprising spaced stationary electric contacts secured to said housing; said bimetal strip constituting a movable contact bridge cooperating with said stationary electric contacts; said bimetal strip electrically connecting said stationary electric contacts upon outward deformation of said collar and said bimetal strip electrically disconnecting said stationary contacts from one another upon inward deformation of said collar.

11. An electrically operated door lock as defined in claim 10, wherein one of said stationary electric contacts is constituted by said abutment and cooperates with said support terminus and another of said stationary contacts cooperates with said bolt-actuating terminus.

* * * * *